US009909273B2

(12) United States Patent
Al Adawi

(10) Patent No.: US 9,909,273 B2
(45) Date of Patent: Mar. 6, 2018

(54) SNOW SHOVEL WITH REVERSING ELEMENT

(71) Applicant: Walid Al Adawi, Ludiano (CH)

(72) Inventor: Walid Al Adawi, Ludiano (CH)

( * ) Notice: Subject to any disclaimer, the term of this patent is extended or adjusted under 35 U.S.C. 154(b) by 0 days.

(21) Appl. No.: 15/501,207

(22) PCT Filed: Aug. 3, 2015

(86) PCT No.: PCT/IB2015/055878
§ 371 (c)(1),
(2) Date: Feb. 2, 2017

(87) PCT Pub. No.: WO2016/020823
PCT Pub. Date: Feb. 11, 2016

(65) Prior Publication Data

US 2017/0226710 A1 Aug. 10, 2017

(30) Foreign Application Priority Data

Aug. 4, 2014 (CH) ..... 1181/14

(51) Int. Cl.
*E01H 5/02* (2006.01)

(52) U.S. Cl.
CPC ..... *E01H 5/02* (2013.01)

(58) Field of Classification Search
CPC ..... E01H 5/02; A01B 1/022; A01B 1/026; A01B 1/028; A01B 1/225; B62B 1/147
USPC ..... 294/53.5, 54.5; 37/265, 285; 254/131.5
See application file for complete search history.

(56) References Cited

U.S. PATENT DOCUMENTS 3,833,262 A * 9/1974 Tasse ..... B62B 1/24 298/2
5,018,282 A * 5/1991 Hong ..... B62B 1/147 37/265
5,048,206 A * 9/1991 Jones ..... B62B 1/147 280/651

(Continued)

FOREIGN PATENT DOCUMENTS

JP S54 113247 U 8/1979
JP S58 76623 U 5/1983

(Continued)

OTHER PUBLICATIONS

International Search Report, dated Nov. 17, 2015, from corresponding PCT application.

*Primary Examiner* — Dean J Kramer
(74) *Attorney, Agent, or Firm* — Young & Thompson

(57) ABSTRACT

A snow shovel with a tilting element includes an elongated support having upper and lower ends opposite the upper end and a blade having front and opposite rear portions. The blade is mounted at the lower end of the elongated support and is designed to be movable with a rotary motion between a first shoveling position and a second snow dumping position in which it is at least partially spaced from the elongated support. The blade pivots with respect to the elongated support at a substantial front-end portion thereof. The elongated support includes at least one pair of sliding elements shaped for crawling in use on the ground where the snow shovel rests. The snow shovel includes a rotating unit to rotate the blade operated by a connecting rod, the rotating unit being arranged to allow the blade to rotate between the first and second snow positions.

14 Claims, 4 Drawing Sheets

(56) References Cited

U.S. PATENT DOCUMENTS

| | | | | | |
|---|---|---|---|---|---|
| 5,074,064 | A * | 12/1991 | Nickels | E01H 5/02 | 37/265 |
| 5,271,169 | A * | 12/1993 | Konsztowicz | E01H 5/02 | 37/270 |
| 5,581,915 | A * | 12/1996 | Lobato | E01H 5/02 | 280/47.34 |
| 7,654,592 | B2 * | 2/2010 | Stenzel | E01H 5/02 | 294/54.5 |
| 7,681,932 | B2 * | 3/2010 | Chang | E01H 5/02 | 294/54.5 |
| 8,550,515 | B2 | 10/2013 | Castillo | | |

FOREIGN PATENT DOCUMENTS

| | | |
|---|---|---|
| JP | S62 154021 U | 9/1987 |
| JP | 2014015775 A | 1/2014 |

* cited by examiner

SNOW SHOVEL WITH REVERSING ELEMENT

TECHNICAL FIELD

The present invention relates to a snow shovel and, in detail, a tilting snow shovel.

KNOWN ART

Shoveling and removing snow with a snow shovel is a difficult and tiring job, especially when a great amount of snow has to be shoveled and when the snow is wet and therefore heavy. This is particularly true where shoveling is carried out using traditional hand shovels provided with a transversely elongated body (the actual blade) and a handle to be held by the user having a lower end connected to the actual blade. Although these shovels are substantially useful for shoveling small amount of snow and are characterized by a low price, however in use they substantially cause tiredness. The prolonged use of such shovels can even lead to real health problems, especially at the back.

There are also mechanized snow shovels equipped with electromechanical, hydraulic or motorized actuators which, although being able to almost completely ease the shoveling effort, are characterized by a cost usually not bearable for private users, therefore being intended for professional users.

Document U.S. Pat. No. 8,550,515 B2 discloses a snow removing shovel comprising an elongated support having an upper end and a lower end opposite the upper end and a blade characterized by a lower portion for engaging the ground and by an opposite rear portion. Such blade is mounted at the lower end of said elongated support and is arranged so as to move with a rotary motion between a first shoveling position and a second snow dumping position in which it moves away from said elongated support. In detail, the shovel referred to in the above mentioned U.S. document is characterized by some drawbacks. In detail, the ground engaging portion, if the blade tilts from the shoveling position to the snow dumping position, causes the blade and the elongated support to be raised altogether above the ground.

For this reason it is necessary, first of all, that the ending portion of the shovel is very resistant, otherwise under the snow load and due to a repeated use it would run the risk of deteriorating and breaking down.

Secondly, this solution makes it difficult to change the operating position between the shoveling position and the snow dumping position, just because in addition to the weight of the snow to be tilted, also the weight of the blade itself has to be lifted.

Furthermore, the lower edge of the blade engaging the ground can get wedged, particularly in case of use on uneven or anyway rough ground. This may cause indirect muscle stress to a user.

Finally, the tilting control, being manually operated, works depending on the gripping ability of the user's hands and is therefore not suitable to be used by women users, because they have smaller and weaker hands with respect to men.

The object of the present invention is therefore to describe a snow shovel which is free from the above described drawbacks.

SUMMARY OF THE INVENTION

According to the present invention a snow shovel with tilting element is obtained, said snow shovel comprising an elongated support or frame having an upper end and a lower end opposite the upper end and a blade having a front portion and an opposite rear portion; said blade is mounted at the lower end of said elongated support and is designed so as to move with a substantially rotary motion between a first shoveling position and a second snow dumping position in which it is at least partially spaced from said elongated support or frame; said snow shovel is characterized in that:

said blade is rotatably pivoted with respect to said elongated support or frame at a substantial front-end portion thereof;

the snow shovel comprises means for rotating said blade operated by a connecting rod, said rotating means being arranged so as to allow said blade to rotate between said first shoveling position and said second snow dumping position;

said rotating means comprise at least one first connecting rod hinged at an intermediate portion thereof so as to be able to rotate with respect to said elongated support or frame and having a first end mechanically joined to said rear portion of said blade, at an upper portion thereof, by at least one second connecting rod, the rotation of said first connecting rod causing said blade to rotate between said first shoveling position and said second snow dumping position.

Preferably, said elongated support comprises at least one pair of sliding elements designed for crawling in use on the ground where said snow shovel rests.

Advantageously, in the first position the second connecting rod is arranged at least partially above said blade and, with respect to the first connecting rod, so as to form an angle $\alpha$ less than 135° between the first and the second connecting rod.

Advantageously, in the first position the second connecting rod is arranged at least partially above the blade and, with respect to the first connecting rod, so as to form an angle $\alpha$ greater than 60° between the first and the second connecting rod.

Preferably, the rotating means can be operated by a pedal control.

Advantageously, said at least one first connecting rod comprises a second end mechanically joined to said pedal control.

Advantageously, said at least one first connecting rod is mechanically joined to said pedal control by a third connecting rod, said first, second and third connecting rods being arranged so as to form a four-bar linkage.

Preferably, said at least one first connecting rod is hinged to an element projecting from said elongated support or frame.

Conveniently, the snow shovel comprises a rear portion supporting said pedal control, having a pair of side elements and a crossbeam constrained to respective rear ends of said side elements and acting as an abutting element raised above the ground, and in which the two side elements form a convex angle with respect to the portion of elongated element or frame substantially contacting said ground.

Advantageously, the frame comprises a pair of left and right posts, respectively, joined together at said upper end thereof by a first crossbeam.

Preferably, the connecting-rod rotating means comprise an intermediate and rotary engaging point rotatably constrained on said posts.

Conveniently, the snow shovel according to any one of preceding claims further comprises a release control of the rotating means.

Advantageously, the first crossbeam forms a handle of said snow shovel.

Preferably, said pedal control is rotatably constrained to the rear portion of the elongated element at a rear end thereof.

Conveniently, at least one portion of the snow shovel can be closed and/or folded and/or disassembled in order to reduce the bulk of the snow shovel when not used.

DESCRIPTION OF THE ATTACHED FIGURES

In the present description reference will be made to a preferred, non-limiting embodiment of the invention, by referring to the appended figures, wherein.

DETAILED DESCRIPTION OF THE INVENTION

Figure 1:
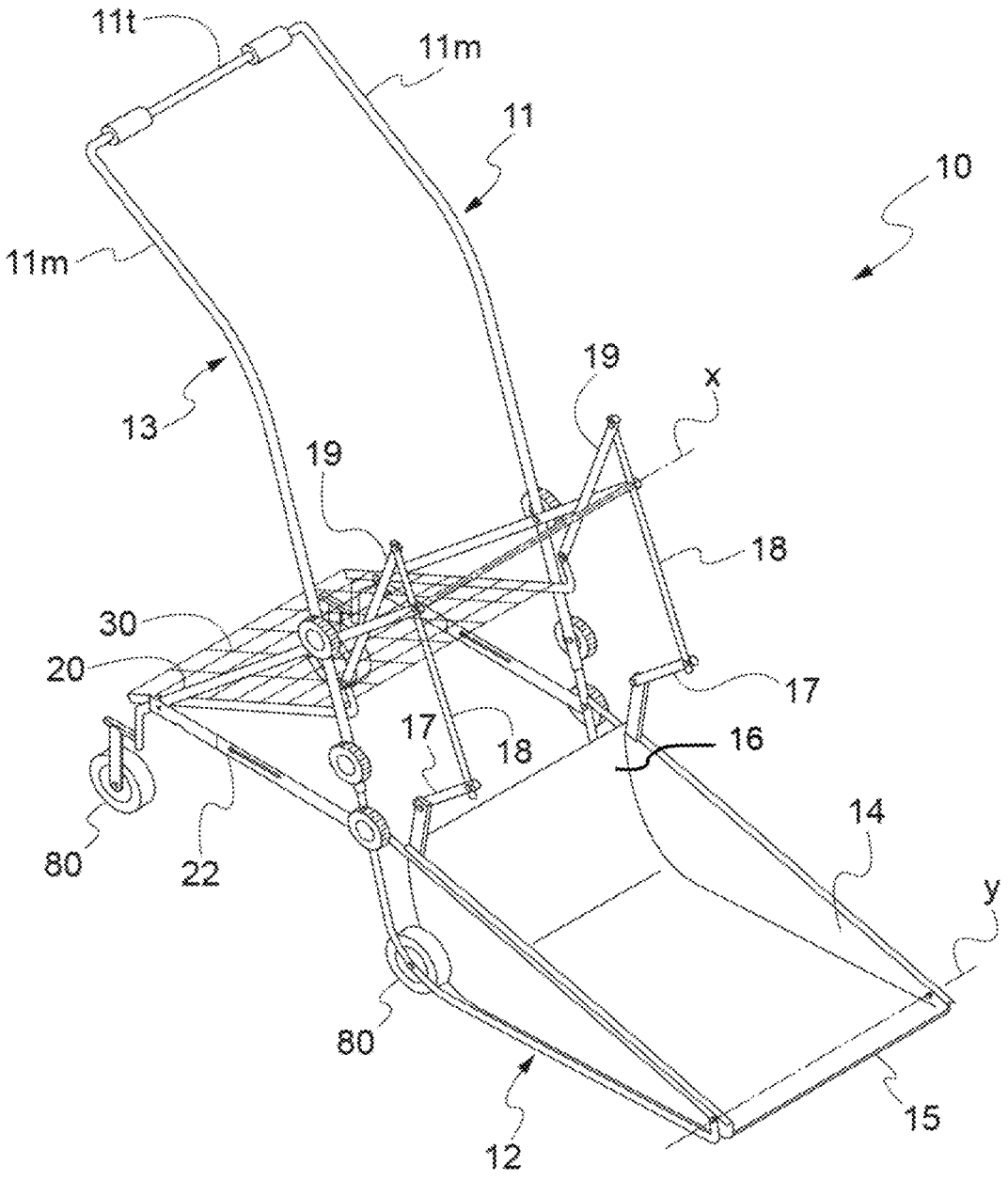
FIG. 1 is a schematic three-dimensional view of a snow shovel object of the present invention.

Referring to the attached figures, a snow shovel as a whole is denoted with the numeral reference 10.

The snow shovel 10 comprises a frame 11 made with a shape of elongated support comprising a first lower end 12 and a second upper end 13.

The frame 11 defines a pair of posts 11*m* respectively positioned on the left and right sides of the snow shovel 10, and a hand grip crossbeam 11*t* substantially orthogonally oriented with respect to said posts 11*m* and joining the latter exactly at the second upper end 13. The frame 11 of the snow shovel 10 object of the present invention is symmetrical, thereby allowing to obtain in use a rigid structure able to manage even greater snow loads.

Although in FIG. 1 rectilinear posts 11*m* are shown, they can also take a curved shape, without departing from the protection scope of the present invention.

At the crossbeam 11*t* there is a pair of ergonomic knobs facilitating the grip of the snow shovel 10 object of the present invention and advantageously allowing the optimization of the muscle effort applied thereto by the hands.

In detail, the frame 11 of the snow shovel object of the present invention can be made of a galvanized metal material able to resist corrosion that may occur in environments where the snow is tried to be melted by salt, or else of a synthetic and/or aramid material.

In detail, the first lower end 12 acts as a support of the snow shovel 10 object of the present invention and is made so as to comprise a pair of portions that, in use, are designed to crawl on the ground and are orthogonally oriented with respect to the direction defined by the width of the shovel itself. In detail, this pair of portions forms a sliding block allowing the snow shovel object of the present invention to slide.

The actual blade 14 is installed on the first lower end 12 and, in the embodiment depicted in the appended figures, has a substantially triangular and planar sectional shape defining a lower front portion 15 and an upper rear portion 16, since the blade 14 is tilted forward so as to facilitate the loading of the snow when the latter is pushed by the user towards it.

The shape of the blade 14 is not to be considered as restrictive because the blade itself can be made, for example, with a concave shape.

The blade 14 is rotatably pivoted on said elongated support 11 and, in detail, on the first lower end, at its first front lower portion 15, so that the point of rotation of the blade 14 substantially takes place around an axis Y-Y orthogonal to the forward direction of the snow shovel 10, however being as close as possible to the front end. Advantageously in this way, during the rotation of the blade 14 which will be better described in the following description, it is not required to lift the whole snow shovel 10. Advantageously, this results in less effort using the shovel.

In the embodiment shown in figures, at the front lower portion of the blade 14 there is a reinforcing crossbeam allowing to provide the assembly with a greater stiffness at the front portion of the snow shovel 10, which is the most stressed in use.

The snow shovel 10 is characterized in that it is able to rotate around said rotation axis between a first snow shoveling position and a second snow dumping position in which the rear upper portion is substantially raised with respect to the front lower portion so as to cause the snow pile loaded on the blade 14 to fall from the blade itself.

With this aim, the snow shovel 10 object of the present invention comprises rotating means 17, 18, 19, 20 to rotate said blade, which are designed in all respect for allowing the latter to rotate between the first shoveling position and the second snow dumping position.

In detail, these rotating means comprise a pair of second connecting rods 17 symmetrically arranged on the left and right side of the blade 14 at the upper rear portion 16 thereof, and in detail which are rotatably constrained thereto at their first end opposite to their second end to which instead a pair of first connecting rods 18 is constrained.

Each first connecting rod 18 comprises a first end rotatably constrained to a second end of a respective second connecting rod 17 and a second end pivoted to a first end of a third connecting rod of a pair of third connecting rods 19, whose second end is constrained to a control pedal 30 for controlling the rotation of the blade.

Advantageously, the extent of each first connecting rod 18 is greater than the extent of a second connecting rod 17.

The first 18, second 17 and third 19 connecting rods are arranged so as to form a four-bar linkage.

In the first shoveling position each second connecting rod 17 is at least partially arranged above the blade 14 and, with respect to the first connecting rod, so as to form an angle $\alpha$ less than 135° between the first 18 and the second 17 connecting rods.

In the second snow dumping position, each second connecting rod 17 is at least partially arranged above the blade 14 and, with respect to the first connecting rod 18, so as to form an angle $\alpha$ less than 60° between the first 18 and the second 17 connecting rods.

While the blade 14 rotates from the first to the second position, the angle $\alpha$ between the first 18 and second 17 connecting rods initially decreases but then increases, thereby creating a catapulting effect causing the snow to be launched away from the blade 14 itself.

The control pedal 30 extends along the entire width of the blade with a preferably, but not exclusively, rectangular shape, thereby advantageously providing greater ease of activation.

This control pedal 30 is pivoted to the frame 11 at a lower rear element 21 extending downwards to the lower rear area of the snow shovel itself.

More in detail, this lower rear element 21 of the frame 11 comprises a pair of parallel longitudinal elements 22 joined together at a rear crossbeam 23 or the control pedal 30 at their first end, and at their second end opposite the previous one, at a pair of posts 11*m* of the frame.

Figure 5:
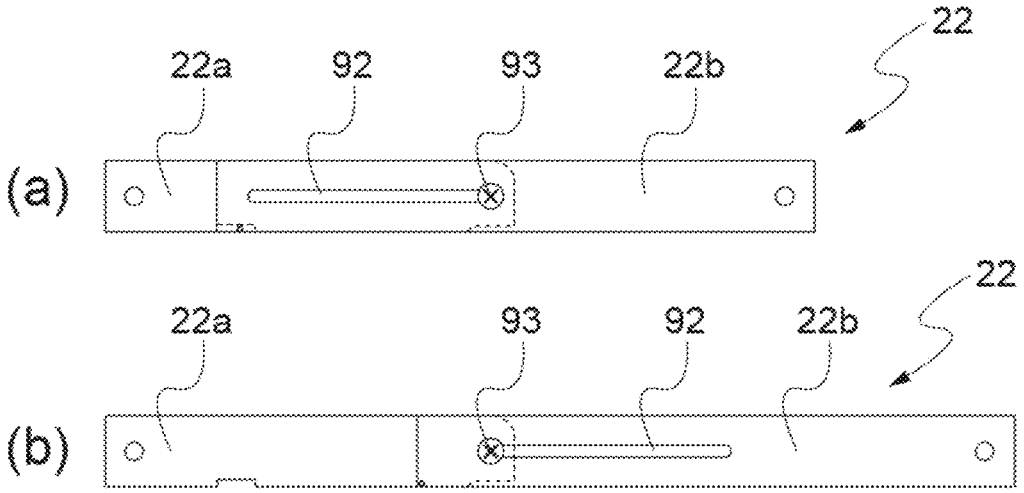
FIG. 5 shows a detail of a longitudinal element of the frame of FIG. 1 in a closed and open arrangement, respectively.

According to an embodiment shown in FIG. 5, each longitudinal element 22 comprises two portions 22*a*, 22*b* telescopically coupled to each other in order to reduce the extent of the element 22 and, thus, the bulk of the snow shovel 10 when not in use, for example at the end of the season.

For this purpose, in order to adjust the extent of the element 22, one of the two portions 22*a* may comprise a pin 93 sliding within a slot 92 obtained in the other portion 22*b*. The pin can be eventually tightened to block the relative position of one portion with respect to the other and therefore the extent of the element 22.

Finally, the rotating means of the blade comprise a pair of transverse posts 20 respectively positioned on the left and right side of the snow shovel 10; these transverse posts 20 are fastened to a respective post 11*m* of the frame 11.

A first end of each transverse post 20 is pivoted to a first connecting rod 18 preferably at an intermediate position thereof, so that the latter can rotate, and a second end is fastened to the lower rear element 21 of the frame 11.

In detail, the transverse posts 20 are rigidly constrained to the posts 11*m* of the frame so that their first end extends towards the front portion of the snow shovel 10 and is, anyway, in a more advance position with respect to the portion of the posts 11*m* that is substantially at the same height.

As depicted in FIG. 1, the transverse posts 20 comprise a left end portion and an opposite right end portion joined to each other by an intermediate tubular portion substantially as wide as the blade 14.

Figure 2:
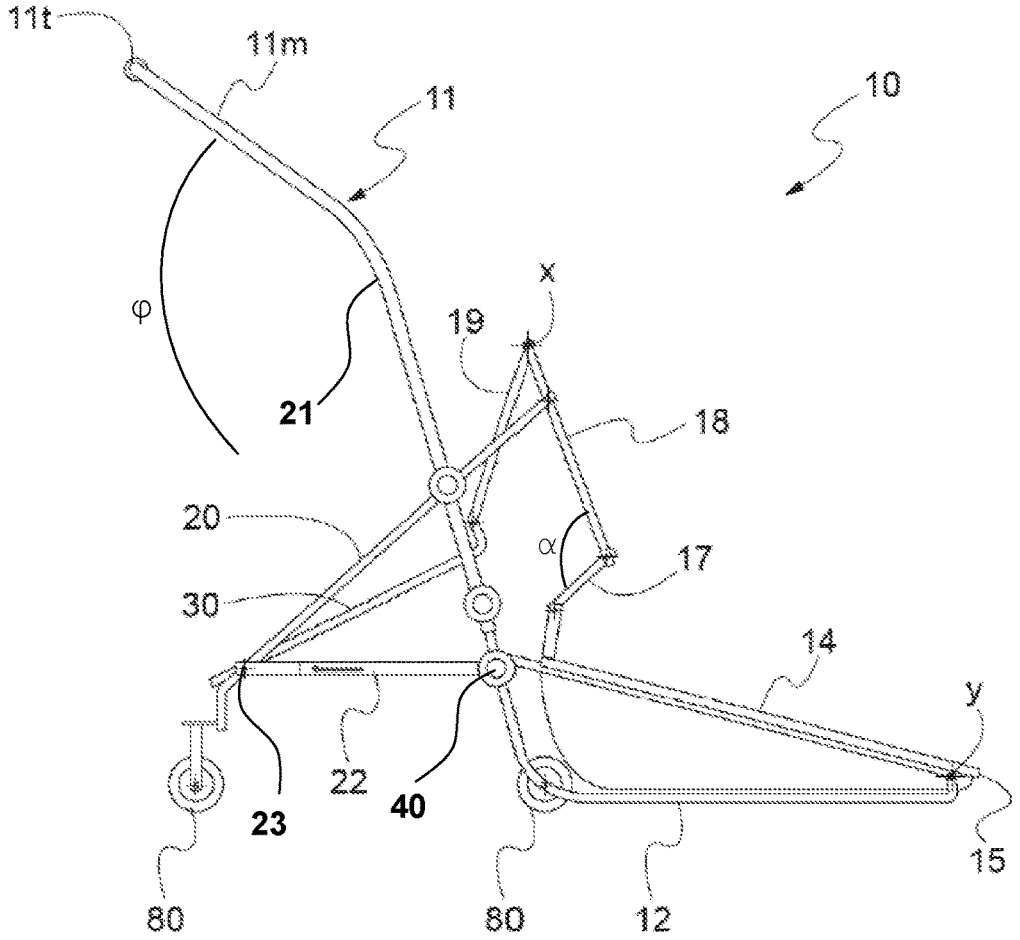
FIG. 2 is a schematic side view of the snow shovel object of the present invention, the blade being in the first shoveling position.
Figure 3:
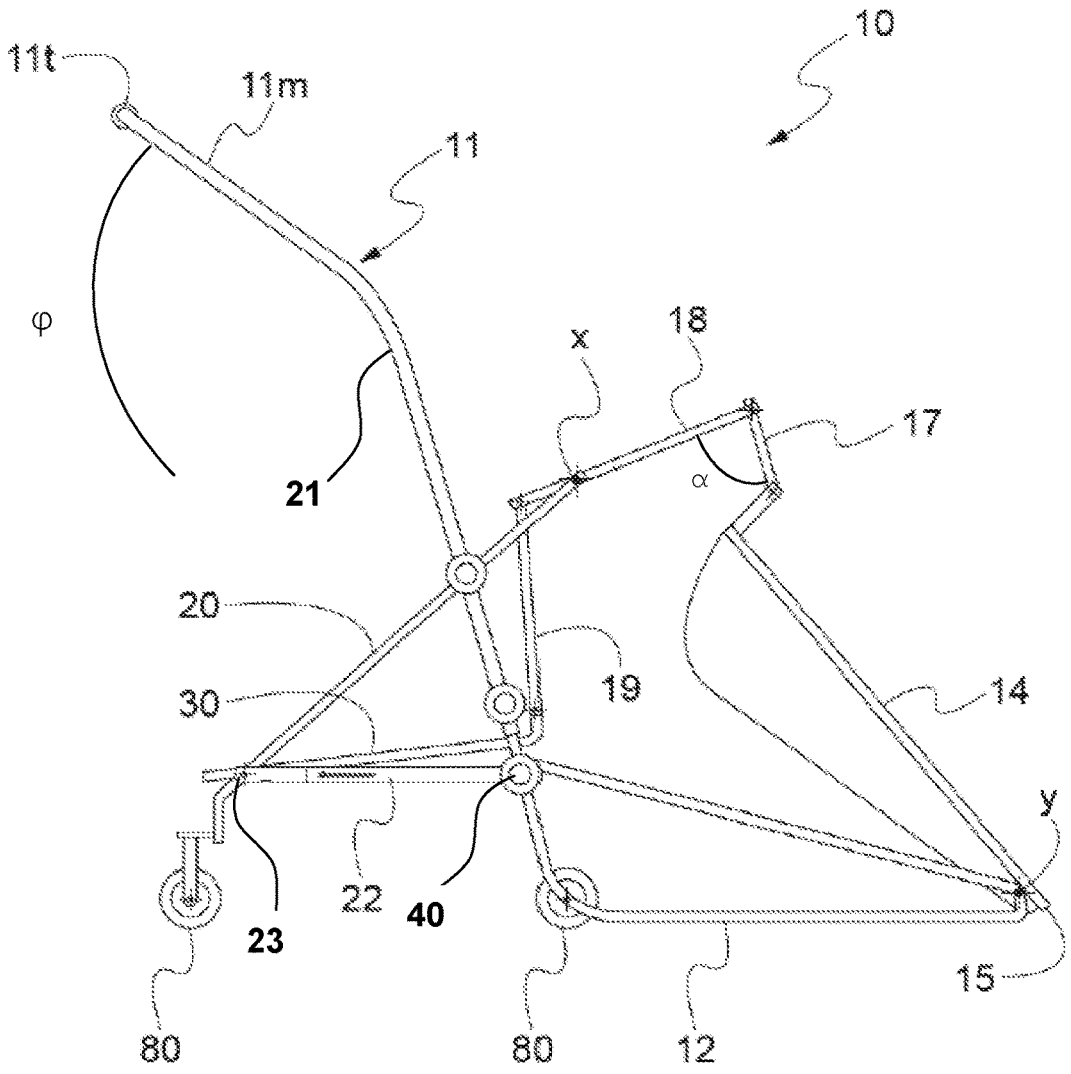
FIG. 3 is a schematic side view of the snow shovel object of the present invention, the blade being in the second dumping position.
Figure 4:
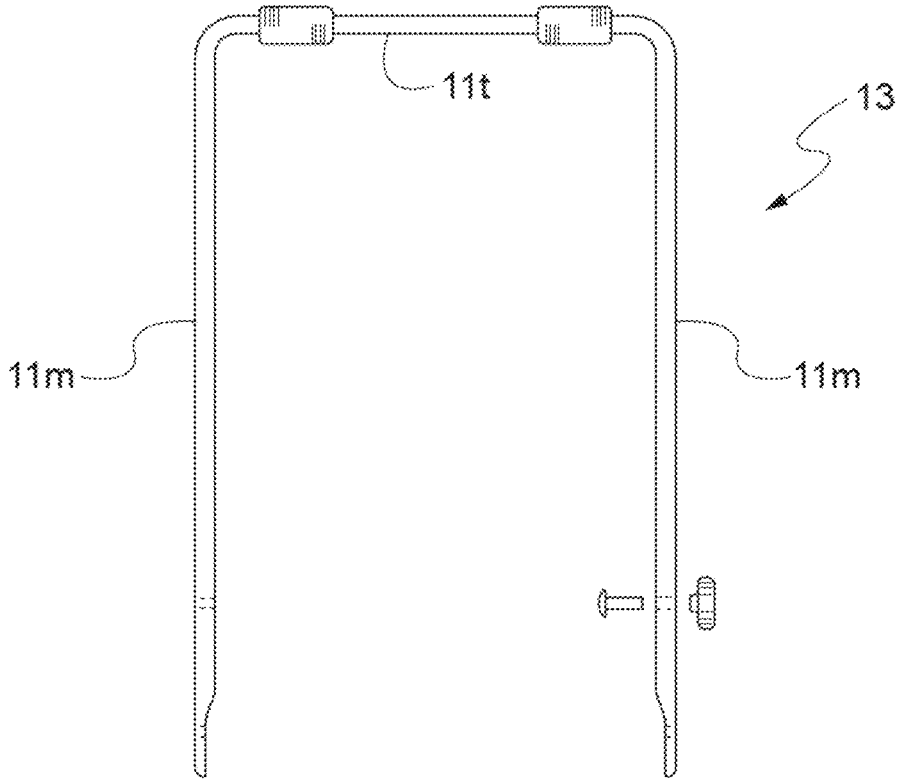
FIG. 4 shows a detailed view of the second rear end of the frame of the snow shovel of FIG. 1, but observed along an orthogonal direction.

The action of the user's foot on the control pedal 30 causes the latter to rotate around its rear portion on which it is constrained to the lower rear portion 21 of the frame. Therefore, in this way, the front portion of the control pedal 30 is lowered thereby driving downwards the third pair of connecting rods 19, which causes in its turn the second pair of connecting rods 18 to rotate around the pivot point formed on the second end of the transverse posts 20. Accordingly, the second end of the connecting rods of the second pair of connecting rods 18 is pulled downwards while their first end is rotated upwards (when observing the snow shovel 10 object of the present invention as in FIG. 2, upon pressing the control pedal 30 the connecting rods of the second pair of connecting rods rotate clockwise). Accordingly, also the first pair of connecting rods 17 is pulled upwards, thereby causing the upper rear portion 16 of the blade 14 to substantially raise and thus the switching between the shoveling position and the snow dumping position.

It should be noted that the lower rear portion 21 of the frame 11 is joined to the posts 11*m* at a lower portion thereof so as to determine a convex angle $\phi$ [°] (measured including the ground) with respect to the sliding blocks. Substantially this allows the user, by applying a pressure at the rear portion of the control pedal 30, causing the entire snow shovel 10 object of the present invention to swing around a swinging point 40 which is located at the rear portion of said slide blocks. In this way, advantageously, the front portion of the blade 10 can be raised during activation or in case of rough ground.

In order to allow the snow shovel 10 to slide on any kind of ground, wheels 80 can be additionally provided.

In particular, wheels 80 can be provided at the swinging point 40 and, at the rear end of the lower rear element 21 additional wheels can be provided, the latter can be fastened to the lower rear element 21 by elastic means, such as coil springs, acting so as to counter the weight of the snow shovel 10.

In order to be sure to prevent the unintentional movement of the blade 14 between the first snow shoveling position and the second snow dumping position, the snow shovel 10 object of the present invention can further comprise locking and releasing means to lock and release the blade 14, which are shaped so as to be manually operated by the user. In detail, said locking and releasing means can comprise a U-shaped tension rod having a first portion extending at the hand grip crossbeam 11*t* and a pair of filiform or cylindrical elements extending to the left and right along the posts 11*m* of the frame 11, so as to provide transfer means extending up to a swinging assembly which is on the left post and on the right post, in order to assure a symmetrical and more stable locking.

Although reference has been made to tension rods passing through holding clamps positioned on the posts 11*m*, such a solution should not be considered as restrictive because it is advantageously possible to constrain said transfer means by a cable provided with a sheath, preferably made of plastic, of the Bowden type.

In detail, said swinging block is made from a beam pivoting at a central portion thereof on the post 11*m* and having a chase or recess open upwards, i.e. towards the upper portion of the frame 11, in which a knife is inserted, the knife being directly constrained to the control pedal 30 or to a guide sliding on the post 11*m* itself and being in turn fastened to the control pedal.

While the two left and right side portions of the tension rod engage themselves in a hole on a first end of said swinging block, the second end of the latter is instead constrained to a spring acting as elastic means for retaining said swinging block in a rest position in which the spring is minimally extended and keeps the knife within the recess or chase. When the user pulls said tension rod, the action of the two side portions of the latter applies a force on the swinging block that, by extending the spring and causing the first end of said block to be raised, releases the knife out of the chase, thereby allowing the control pedal 30 to lower, causing the blade 14 to rotate.

In light of the foregoing description, the advantages of the snow shovel 10 object of the present invention become clear. Since the blade 14 is rotated along a rotation axis Y-Y substantially coincident with the extreme front portion of the blade itself, the rotation is facilitated without needing to lift the whole assembly of the snow blade 10. As a result, the user's effort on the control pedal 30 concerns only the weight of the snow on the blade.

Moreover, by suitably arranging the first, second and third pair of connecting rods 17, 18, 19 to form the levers it is possible to achieve a more or less advantageous lever which is able to reduce the effort on the control pedal 30, thereby allowing a greater amount of snow to be dumped with the same effort.

Unlike the known art, the pedal control 30 provides a great advantage: by using the feet on a pedal, even a light or not very strong user can apply a definitely greater force with respect to that obtainable by using one or two hands. Accordingly, by using the snow shovel 10 object of the present invention, great amounts of snow can be shoveled and dumped from the blade 14 regardless of the strength of the hands, providing greater ease of use, for example, to female users who are characterized by a lower resistance of the hands with respect to men.

Because is able to crawl on the ground, the snow shovel object of the present invention slides better and does not arrest at the unevenness of the ground. This advantageously allows muscle stress caused by a sudden arrest straining the user to be reduced.

Lastly, it is evident that variations, additions and modifications, obvious for a person skilled of the art, can be applied to the snow shovel object of the present invention without thereby departing from the protection scope provided by the enclosed claims.

The invention claimed is:

1. A snow shovel with a tilting element, said snow shovel comprising:

an elongated support or frame having an upper end and a lower end opposite the upper end; and a blade having a front portion and an opposite rear portion; said blade is mounted at the lower end of said elongated support and is designed so as to be able to move with a rotary motion between a first shoveling position and a second snow dumping position in which the blade is at least partially spaced from said elongated support or frame wherein:

said blade is rotatably pivoted with respect to said elongated support or frame at a substantial front-end portion thereof;

said elongated support or frame comprises at least one pair of sliding elements designed for crawling in use on the ground where said snow shovel rests;

the snow shovel comprises rotating means to rotate said blade operated by a connecting rod, said rotating means being arranged so as to allow said blade to rotate between said first shoveling position and said second snow dumping position;

said rotating means comprise at least one first connecting rod which comprises a second end mechanically joined to a pedal control and hinged at an intermediate portion thereof so as to be able to rotate with respect to said elongated support or frame and having a first end mechanically joined to said rear portion of said blade, at an upper portion thereof, by at least one second connecting rod, the rotation of said first connecting rod causing said blade to rotate between said first shoveling position and said second snow dumping position, in said second dumping position the second connecting rod is arranged at least partially above said blade and, with respect to the first connecting rod, so as to form an angle a less than 60° between the first and the second connecting rod, and said at least one first connecting rod is mechanically joined to said pedal control by at least one third connecting rod, said first, second and third connecting rods being arranged so as to form a three-bar linkage.

2. The snow shovel according to claim 1, wherein in said first shoveling position the second connecting rod is arranged at least partially above said blade and, with respect to the first connecting rod, so as to form an angle $\alpha$ less than 135° between the first and the second connecting rod.

3. The snow shovel according to claim 2, wherein said pedal control is rotatably constrained to a rear portion of an elongated element at a rear end thereof.

4. The snow shovel according to claim 2, wherein said rotating means are operated by the pedal control.

5. The snow shovel according to claim 2, wherein at least one connecting rod is hinged to an element projecting from said elongated support or frame.

6. The snow shovel according to claim 1, wherein said rotating means are operated by the pedal control.

7. The snow shovel according to claim 6, wherein said connecting-rod rotating means comprise an intermediate and rotary engaging point rotatably constrained on posts.

8. The snow shovel according to claim 6, wherein at least one connecting rod is hinged to an element projecting from said elongated support or frame.

9. The snow shovel according to claim 1, wherein at least one connecting rod is hinged to an element projecting from said elongated support or frame.

10. The snow shovel according to claim 9, wherein a first crossbeam forms a handle of said snow shovel.

11. The snow shovel according to claim 1, said frame comprises a pair of respectively left and right posts joined together at said upper end thereof by a first crossbeam.

12. The snow shovel according to claim 1, further comprising a release control of said rotating means.

13. The snow shovel according to claim 1, wherein at least one portion thereof can be closed and/or folded and/or disassembled in order to reduce a bulk of the snow shovel when not used.

14. A snow shovel with a tilting element, said snow shovel comprising:

an elongated support or frame having an upper end and a lower end opposite the upper end;

a blade having a front portion and an opposite rear portion;

said blade is mounted at the lower end of said elongated support and is designed so as to be able to move with a rotary motion between a first shoveling position and a second snow dumping position in which the blade is at least partially spaced from said elongated support or frame; and a rear portion supporting pedal control, having a pair of side elements and a crossbeam constrained to respective rear ends of said side elements and acting as an abutting element raised above the ground, and in which the two side elements form a convex angle with respect to the portion of elongated support or frame substantially contacting said ground, wherein said blade is rotatably pivoted with respect to said elongated support or frame at a substantial front-end portion thereof;

said elongated support or frame comprises at least one pair of sliding elements designed for crawling in use on the ground where said snow shovel rests;

the snow shovel comprises rotating means to rotate said blade operated by a connecting rod, said rotating means being arranged so as to allow said blade to rotate between said first shoveling position and said second snow dumping position;

said rotating means comprise at least one first connecting rod hinged at an intermediate portion thereof so as to be able to rotate with respect to said elongated support or frame and having a first end mechanically joined to said rear portion of said blade, at an upper portion thereof, by at least one second connecting rod, the rotation of said first connecting rod causing said blade to rotate between said first shoveling position and said second snow dumping position.

* * * * *